United States Patent [19]

Prescott

[11] Patent Number: 4,461,159

[45] Date of Patent: Jul. 24, 1984

[54] APPARATUS FOR THE STABILIZATION OF FIBERS

[75] Inventor: Roger Prescott, Johnson City, Tenn.

[73] Assignee: Great Lakes Carbon Corporation, New York, N.Y.

[21] Appl. No.: 480,458

[22] Filed: Mar. 30, 1983

[51] Int. Cl.[3] ..... D06B 3/02

[52] U.S. Cl. ..... 68/5 D; 8/115.5; 34/155; 165/DIG. 6; 165/133; 264/29.2; 423/447.6

[58] Field of Search ..... 68/2, 5 C, 5 D, 5 E; 8/115.5; 264/29.2; 423/447.6; 432/247, 254.1, 254.2; 165/DIG. 6, 133; 34/155

[56] References Cited

U.S. PATENT DOCUMENTS

| | | | |
|---|---|---|---|
| 1,530,064 | 3/1925 | Walsh | 68/2 |
| 2,066,376 | 1/1937 | Walters | 165/DIG. 6 |
| 2,914,915 | 12/1959 | Sziklas et al. | 165/133 X |
| 3,154,141 | 10/1964 | Huet | 165/133 |
| 3,753,666 | 8/1973 | Carroll | 165/133 X |
| 4,278,242 | 7/1981 | Freund et al. | 432/254.1 X |

*Primary Examiner*—Philip R. Coe

*Attorney, Agent, or Firm*—R. Laddie Taylor

[57] ABSTRACT

The wall of an oxidizing chamber for the continuous thermal oxidative stabilization of organic fibers which undergo exothermic reaction during treatment thereof possesses high thermal conductance and has an internal surface of high total normal emissivity to absorb heat from the fibers generated by the exothermic oxidation reaction.

7 Claims, 4 Drawing Figures

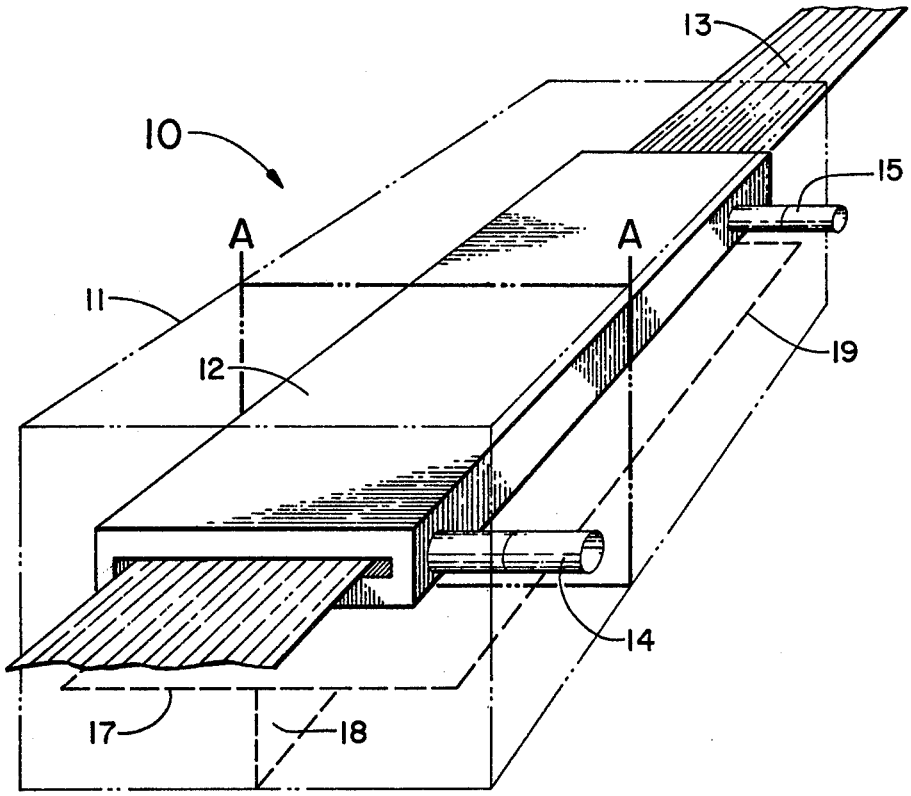
· Fig. 1 ·
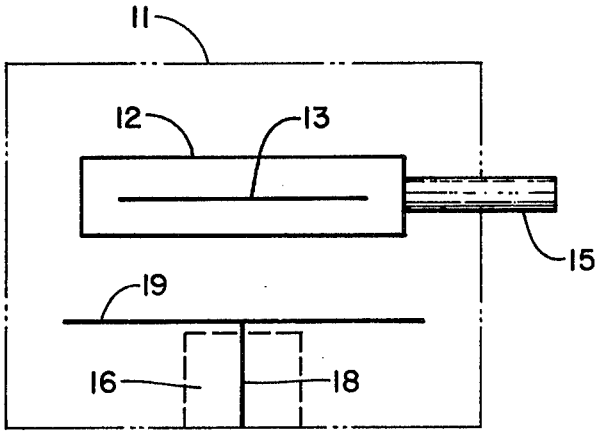
· Fig. 2 ·

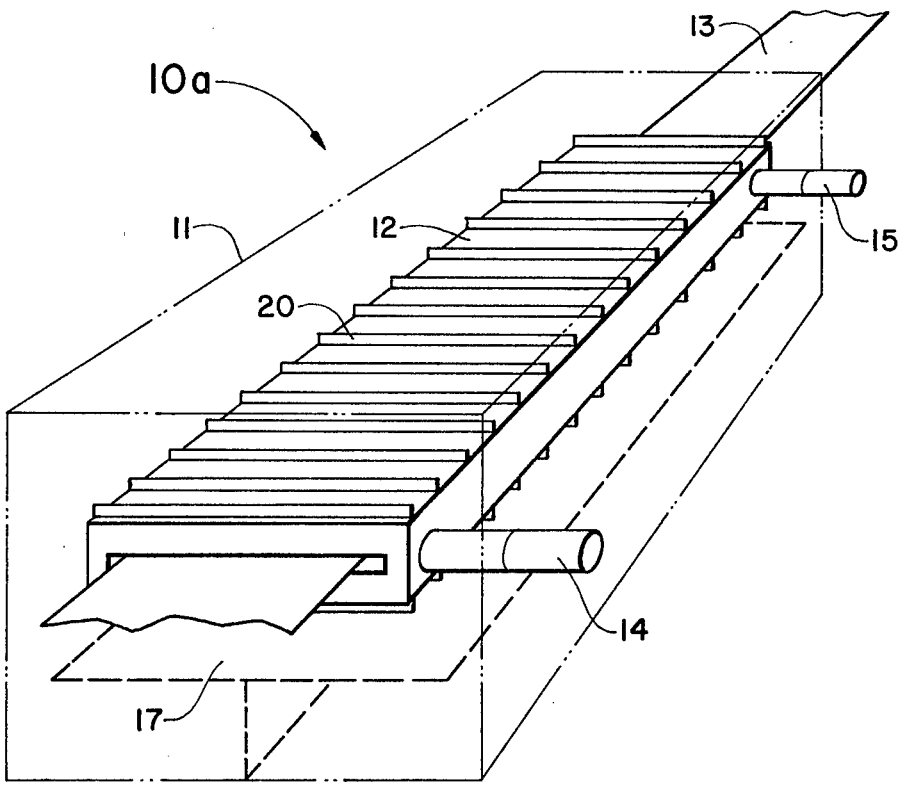
· Fig. 3 ·

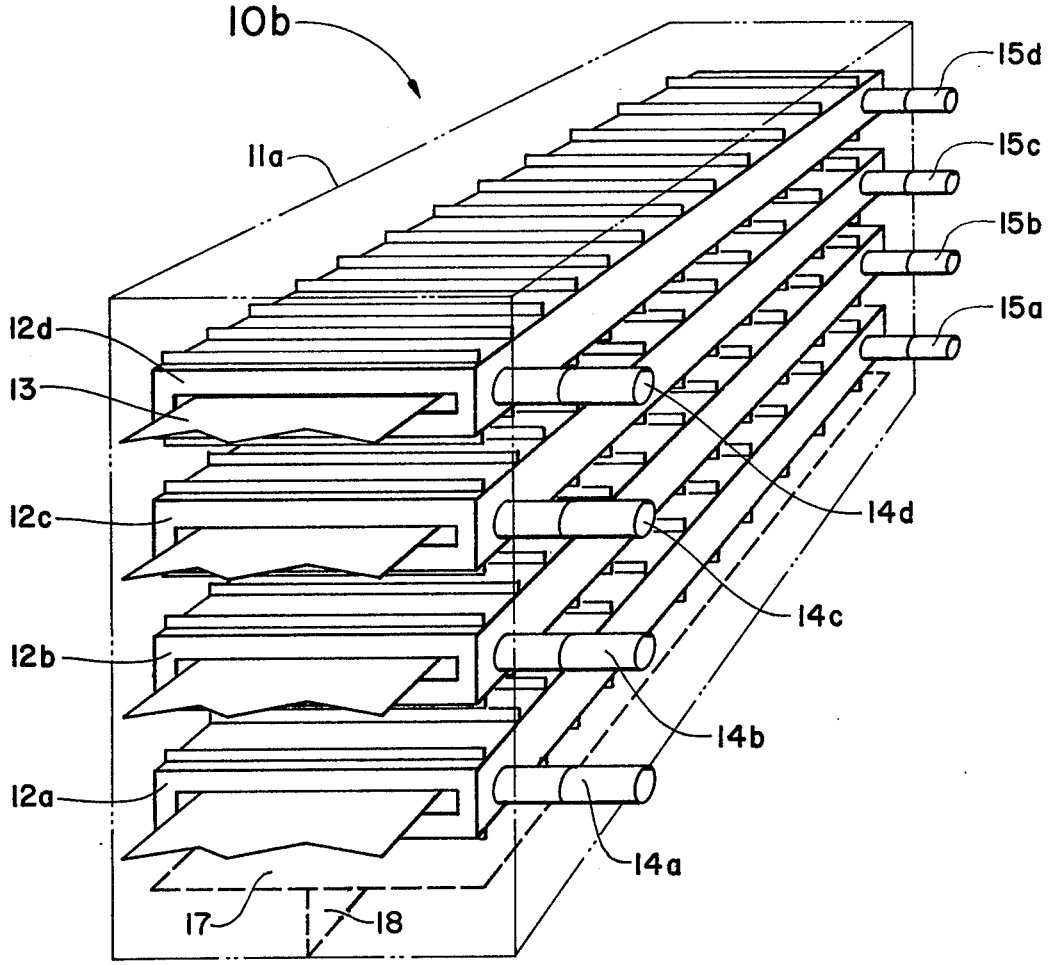
· Fig. 4 ·

APPARATUS FOR THE STABILIZATION OF FIBERS

BACKGROUND OF THE INVENTION

The invention provides an improved apparatus for rapidly thermally stabilizing organic fibers which undergo exothermic reaction during heat treatment in an oxidizing atmosphere, particularly acrylic fibers, whereby the heat produced during oxidative stabilization of the fibers is removed via radiative heat transfer.

The thermal oxidative stabilization of a bundle of organic fibers which undergo exothermic reaction during treatment thereof historically has required a treatment of relatively long duration (e.g., elapsed time of at least about 2 to 24 hours), to obtain a degree of stability at which the fiber bundle is non-burning when subjected to an ordinary match flame and will withstand carbonization temperatures without loss of its fibrous structure. The exothermic oxidation reaction causes the temperature of the fiber bundle to rise above that of the oxidation chamber. Such an excess temperature rise can lead to disintegration of the fibers.

The capacity of a given oxidative stabilization system for this type of fibers is limited by this behavior. The oxidation rate can be increased by raising the treatment temperature, but only to the limit imposed by the rate of heat evolution from the fibers being treated, which also rises with increasing temperature. The fiber throughput can be increased by increasing the packing density or number of filaments passed through the oxidizing chamber. This throughput is limited by the increasing quantity of heat given off during fiber stabilization and by the efficiency with which the system can remove the exothermic heat from the fibers.

A combination of high oxidation rate and high packing density can only be achieved if the fiber oxidation apparatus is constructed to provide for efficient removal of heat from the reacting fiber. Only recently has it been discovered that in a typical oxidation oven, radiation is the principal mechanism of heat transfer between the fiber and oxidizing chamber walls, rather than convection, as has been assumed. For this reason, organic fiber oxidation equipment built to date has been designed to effect heat transfer by convection.

The walls of a conventional chamber for the thermal oxidation of organic fibers are fabricated of thick (e.g., 18 gauge) carbon steel or stainless steel or the like and have a smooth inner surface. Aditionally, the walls are usually insulated. Such walls possess low radiation absorption capacity, low thermal conductance and thus poor heat transfer characteristics. Further, in cases where more than one layer of fibers pass through the apparatus, such layers are not divided by physical barriers, resulting in a situation in which radiant heat is exchanged between fiber layers, rather than being removed from the fibers in a direct manner.

SUMMARY OF THE INVENTION

The present invention provides an apparatus for the continuous thermal oxidative stabilization of organic fibers which undergo exothermic reaction during treatment thereof, that is specifically designed to absorb the heat of reaction of the fibers utilizing features provided to improve heat transfer by radiation.

The apparatus comprises at least one oxidizing chamber through which the fibers are passed, the chamber having a wall of high thermal conductance with at least the internal surface thereof being of high total normal emissivity for absorption of heat from the fibers produced druring oxidation thereof via radiative heat transfer.

Total normal emissivity is a measure of the effectiveness of absorption of heat, and is expressed as the ratio of radiant absorptance of a material to that of a perfect black body at a given temperature. In the specification and claims, "high total normal emissivity" is defined as a total normal emissivity value of at least about 0.7 at the operating temperature of the oxidizing chamber wall.

The term "thermal conductance" as used herein is defined as the rate of energy transfer through unit area of the oxidizing chamber wall with unit temperature difference between the two faces (inside and outside) of the wall. Likewise, the term "high thermal conductance" refers to a conductance value of at least about 10 watts/cm$^2$ °C. at the operating temperature of the wall.

The wall of the oxidizing chamber has heat transfer means whereby the heat produced during oxidation of the fibers, after being transferred to the chamber wall, is effectively removed therefrom. Such means may simply consist of the passage of air over the walls of the chamber, the air having a temperature below that of the walls.

One means of increasing the total normal emissivity of the internal surface of the wall material is to roughen the surface by, e.g., sand blasting or controlled oxidation. Another means comprises painting the internal surface with a dark colored heat resistant paint.

Examples of wall materials of high thermal conductance include relatively thin (e.g., 22 gauge) steel, and thin copper and aluminum alloys.

The wall of the oxidizing chamber preferably has heat conductive cooling fins attached to its external surface to assist in cooling the wall.

In the case where multiple layers of fibers are passed through the oxidizing apparatus, each layer is preferably provided with a separate chamber to aid in heat removal from each fiber layer.

If requried, a multiple pass arrangement can be provided through the apparatus for individual fiber layers.

BRIEF DESCRIPTION OF THE DRAWINGS

The invention will become more apparent when described in conjunction with the drawings, in which like reference numerals designate like parts, and wherein:

FIG. 1 is a sectional isometric view of an oxidation apparatus according to the invention.

FIG. 2 is a sectional end view of FIG. 1 taken along lines A—A.

FIG. 3 is a sectional isometric view of a second embodiment of an oxidation apparatus according to the invention.

FIG.4 is a sectional isometric view of a third embodiment of an oxidation apparatus according to the invention.

DETAILED DESCRIPTION OF THE INVENTION

The thermal stabilization of acrylic fibers will be described in the preferred embodiment of the invention. Such fibers are acrylonitrile homopolymer fibers and copolymer fibers containing at least 85 mol % acrylonitrile. These fibers are commonly supplied as commercial product in the form of tows comprising continuous multifilament bundles conventionally containing about 1,000 to about 160,000 individual fibers.

Referring to FIGS. 1 and 2, an apparatus 10 for the continuous thermal oxidative stabilization of acrylic fibers, which undergo an exothermic reaction during treatment thereof, comprises an enclosure 11 having a chamber 12 therein, supported by suitable means, for passing an acrylic fiber tow 13 therethrough. Chamber 12 has walls of high thermal conductance fabricated from a material such as thin gauge steel, copper or aluminum alloys, with at least the internal surface having high total normal emissivity. Such emissivity may be achieved by roughening the internal surface of the wall by sand blasting. The fiber tow entry and exit ends of chamber 12 are equipped with suitable seals (not shown) to limit ingress of the atmosphere from outside the chamber. An oxidizing gas, such as air or an air-/oxygen mixture, is passed through port 14 into chamber 12 and exits therefrom through port 15. A "T" shaped plenum 17, shown as dashed lines in FIG. 1 for clarity, is positioned within enclosure 11 at an appropriate distance below chamber 12. The ends of the vertical wall 18 and roof 19 of plenum 17 extend to the fiber entry and exit ends of enclosure 11, and the edges of roof 19 terminate a distance from the side of enclosure 11 sufficient to permit circulation of air. An air circulating fan 16, shown schematically in the FIG. 2, is positioned in the vertical wall 18 of plenum 17 to circulate air heated by heating elements (not shown) to required temperature, typically to about 200° to 300° C., to impart oxidative thermal stabilization to the acrylic tow 13. The heating elements are located at a convenient location within enclosure 11, preferably near fan 16. Heat produced by the exothermic reaction of the acrylic fibers during stabilization is extracted through the wall of the chamber 12, due to the thermal conductance of the material utilized to fabricate the wall, and the high total normal emissivity of the interior surface of the wall. Since the wall of chamber 12 becomes hotter than the atmosphere inside enclosure 11, the air circulating in the enclosure tends to remove the excess heat from the wall. This action prevents excessive temperature rise within chamber 12, thus preventing damage or disintegration of the fibers.

An alternate form of the invention is illustrated in FIG. 3 as apparatus 10*a*. The utilization of cooling fins 20 on chamber 12 in enclosure 11 assists in the removal of heat from the walls of chamber 12.

An apparatus 10*b* for the continuous thermal oxidative stabilization of multiple tows of acrylic fiber is illustrated in FIG. 4. Each individual oxidizing chamber 12*a*, 12*b*, 12*c*, and 12*d* has individual gas inlet ports 14*a*, 14*b*, 14*c*, and 14*d*, and gas outlet ports 15*a*, 15*b*, 15*c*, and 15*d* respectively. The heated air inside enclosure 11*a* is circulated around the individual oxidizing chambers by suitable placement of fan 16 in the vertical wall 18 of plenum 17.

While the invention has been described in detail and with reference to a specific embodiment thereof, it will be apparent to one skilled in the art that various changes and modifications can be made therein without departing from the scope and spirit thereof, and, therefore, the invention is not intended to be limited except as indicated in the appended claims.

What is claimed is:

1. An apparatus for the continuous thermal oxidative stabilization of organic fibers which undergo exothermic reaction during treatment thereof having at least one oxidizing chamber for passing said fibers therethrough, said chamber having a wall of high thermal conductance with at least the internal surface thereof being of high total normal emissivity for absorption of heat from sai fibers produced during oxidation thereof via radiative heat transfer, wherein the wall of said oxidizing chamber has heat transfer means whereby the heat produced during oxidation of the fibers is effectively transferred away from said wall.

2. The apparatus of claim 1 wherein the wall of the oxidizing chamber has heat conductive cooling fins attached to its external surface to assist in cooling the wall.

3. The apparatus of claim 1 wherein a separate oxidizing chamber is provided for each layer of fibers passed therethrough.

4. An apparatus for the continuous thermal oxidative stabilization of organic fibers which undergo exothermic reaction during treatment thereof having at least one oxidizing chamber for passing said fibers therethrough, said chamber having a wall of high thermal conductance with at least the internal surface thereof being of high total normal emissivity for absorption of heat from said fibers produced by oxidation thereof via radiative heat transfer, said wall having heat conductive cooling fins attached to its external surface.

5. The apparatus of claim 4 wherein a separate oxidizing chamber is provided for each layer of fibers passed therethrough.

6. The apparatus of claims 1, 2, 3, 4 or 5 wherein the organic fiber is acrylic fiber.

7. An apparatus for the continuous thermal oxidative stabilization of acrylic fibers having at least one oxidizing chamber for passing said fibers therethrough, said chamber having a wall of high thermal conductance with at least the internal surface thereof being of high total normal emissivity for absorption of heat from said fibers produced by oxidation thereof via radiative heat transfer, said wall having heat conductive cooling fins attached to its external surface.

* * * * *